US005603648A

United States Patent [19]

Kea

[11] Patent Number: 5,603,648

[45] Date of Patent: Feb. 18, 1997

[54] OUTDOOR SURVIVAL GARMENT

[76] Inventor: Miriam Kea, 114 Barksdale Rd., Hampton, Va. 23669

[21] Appl. No.: 445,104

[22] Filed: May 19, 1995

[51] Int. Cl.[6] ..... B63C 9/08

[52] U.S. Cl. ..... 441/106; 441/89; 441/98

[58] Field of Search ..... 441/88, 89, 92, 441/93, 101, 102, 104, 105, 106, 112; 2/2.16, 2.17

[56] References Cited

U.S. PATENT DOCUMENTS

| | | | |
|---|---|---|---|
| 1,901,859 | 3/1933 | Anderson | 441/105 |
| 2,429,973 | 11/1947 | Alexander | 44/112 |
| 4,734,072 | 3/1988 | Lastnik | 441/105 |
| 5,370,566 | 12/1944 | Mitchell | 441/106 |

*Primary Examiner*—Jesus D. Sotelo
*Attorney, Agent, or Firm*—Jerome J. Norris

[57] ABSTRACT

An outdoor survival garment having front and back portions and an integral connection including a pair of shoulder connectors extending across the shoulders of the wearer to define a neck opening; a connecting strap to connect the front and back portions over each side of-the wearer; a first solid flotation layer within the front and back portions to float a wearer of the garment in a body of water; an inflatable bladder within the front and back portions to supplement the solid flotation layer; the inflatable bladder being disposed within the garment and extending from the front to the back portions; compressed gas carried within the garment to selectively inflate the bladder; an outermost compartment disposed in the front portion of the jacket that houses a fiber optic lead inside of the outermost compartment, and which houses a LED underneath a fiber optic lead, to collectively provide lighting; at least one battery in a lowermost section of the back portion of the garment to supply power to the fiber optic and LED lighting; an array of solar element conductors or photovoltaic solar cells in a solar panel or fiber optic container in a top most section of the back portion of the garment in electrical connection to repower the fiber optic and LED lighting; at least one electrical heating element within a layer within a lining next removed from an inner most lining or compartment that extends from the front and the back portions of the garment and includes heating coil wires.

10 Claims, 3 Drawing Sheets

OUTDOOR SURVIVAL GARMENT

BACKGROUND OF THE INVENTION

1. Field of the Invention

This invention relates generally to emergency garments, and more particularly, to an outdoor survival jacket to protect a wearer from the adversities of sustained exposure to hazardous outdoor conditions on land or in water, and to enable the wearer to communicate distress signals and to obtain nutrition during the period of sustained exposure.

2. Description of the Prior Art

U.S. Pat. No. 5,326,297 discloses a life vest designed to be worn by a person travelling via water. The life vest is equipped with various pouches and attachments—wherein, amongst the attachments is a solar and battery powered flare signal and a strobe light. If a user falls into the water, the signal device is automatically activated upon contact with water.

An infant flotation seat with a number of signalling devices is disclosed in U.S. Pat. No. 4,725,253. The flotation device is inflated by compressed or chemically generated gas which is activated automatically. Strobe or other emergency flashing lights and a shark repellant may be incorporated in the seat, and the strobe or other emergency lights can be operated by either a rechargeable, replaceable, or solar powered cell.

U.S. Pat. No. 4,687,451 discloses an automatic inflatable life vest that contains a water soluble paper coil. Upon exposure of the water soluble paper coil to water, the cylinder of compressed gases automatically inflate the life vest.

U.S. Pat. No. 4,602,384 discloses an aquatic attack protection suit made of a layer of Kevlar and a thinner outer layer, and between these layers is a shark repellant.

A buoyant emergency life saving device is disclosed in U.S. Pat. No. 4,523,913, wherein the life saving device has a number of compartments containing several different components. Amongst the included components is a beacon light and food.

The prior art survival jackets do not provide heating provisions to prevent a wearer from getting hypothermia, and does not provide a lighting system utilizing solar collectors to provide electricity to battery heating elements or to light emitting diode (LED) leads placed at the ends of fiber optical leads. Neither does the prior art survival vests include an arrangement wherein the fiber optic is channeled back to the solar panel to help recharge the power source, battery, etc.

SUMMARY OF THE INVENTION

One object of the present invention is to provide a laminated or layered outdoor survival jacket that includes provisions for providing heat to a wearer to prevent hypothermia upon sustained exposure to outdoor weather.

A further object of the invention is to provide a laminated or layered outdoor survival jacket which includes a built-in system to provide electricity to heating elements built into the jacket.

A yet further object of the invention is to provide a laminated or layered outdoor survival jacket that includes built-in solar collectors that provide electricity to battery and/or heating elements contained within the jacket and provide electricity to operate LED leads at terminal points of fiber optic leads contained within and on the jacket to illuminate the fiber optic leads to produce emergency light to make the wearer visible at night or under cloudy or low visibility conditions.

A still further object of the invention is to provide a laminated or layered outdoor survival jacket in which a fiber optic system is channeled back to a solar panel to help recharge and repower a battery included in the survival jacket.

The foregoing and other objects of the invention are generally accomplished by providing a jacket having front and back portions and an integral connection therebetween; wherein said integral connection includes a pair of shoulder connectors extending across the shoulders of the wearer to define a neck opening therebetween; at least one separate, releasable, connecting strap disposed on and adapted to connect said front and back portions over each side of the wearer; first flotation means disposed within said front and back portions to floatingly support a wearer of the jacket in a body of water; a second flotation means disposed within said front and said back portions to supplement the first flotation means; said second flotation means including at least one inflatable bladder disposed within the jacket and extending from said front to said back portions; inflation means carried within said jacket to selectively inflate said inflatable bladder; an outermost compartment disposed in the front portion of said jacket that houses a fiber optic lead immediately in the inside of the outermost compartment, and which houses an LED lighting means underneath a fiber optic lead, to collectively provide lighting means; at least one battery in a lower most section of said back portion of said jacket to supply power to said battery component and element under the fiber optic and the LED lighting means; an array of solar element conductors contained within a solar panel disposed at a top most section of said back and/or from a front portion of said survival jacket, said array of solar element conductors being in electrical connection with, and serving to repower said battery and heat elements and supply electric current to components that house the LED pulsating through the fiber optic and said LED lighting means; at least one electrical heating element contained within a layer within a lining or compartment next removed from the inner most lining or compartment that extends from front and back portions of said jacket, and includes heating coil wires; and, wherein said battery is in electrical connection with said electrical heater element to supply said electrical heater element with power.

The foregoing objects and advantages of the outdoor survival jacket of the invention will become more apparent by reference to the drawings and more detailed description of the preferred embodiment of the invention.

DETAILED DESCRIPTION OF THE INVENTION

Figure 1:
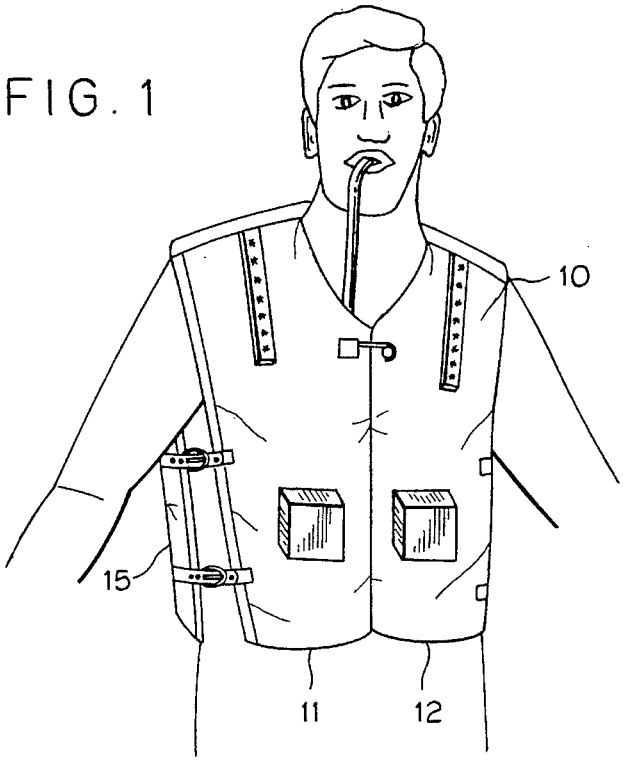
FIG. 1 is a view in perspective showing the outdoor survival jacket in accordance with the invention mounted on the body of a wearer.

Referring to FIG. 1, there is shown an outdoor survival jacket 10 that includes split front portions, forming equal size segments 11,12, that connect through shoulder connectors 13,14 to a one-piece back portion 15. The shoulder connectors 13,14 are configured to define an opening 16 to receive and fit about the neck of a wearer of the jacket.

A pair of straps 17 are secured to back portion 15 and respective front segments 11,12 to define or form arm holes for the wearer of the jacket. At least one retention strap 18, having one end secured to back portion 15, and the other end secured to front segments 11,12 hold the jacket about the waist of the wearer. Straps 17 are equipped with suitable buckle connectors or equivalent conventional fastener devices, that allow adjustment of the strap length in a manner sufficient to provide a tight fit of the jacket on wearers of different sizes.

A fastener system 19 is also disposed on the abutting sides of front segments 11,12. In the preferred embodiment shown in FIG. 2, this fastener system includes velcro fastener elements disposed along the length of the engaging surface of each of front segments 11,12. The velcro fasteners 19 are supplemented by at least one pair of hook and eye fasteners 20, as shown in FIG. 2.

Figure 2:
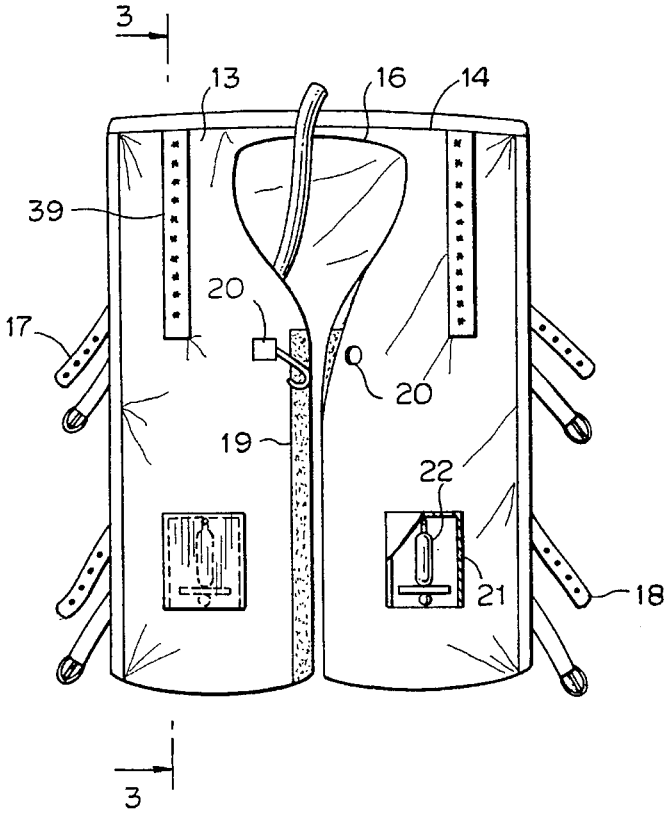
FIG. 2 is a perspective view of the outdoor survival jacket by itself, with certain parts being opened-out.
Figure 3:
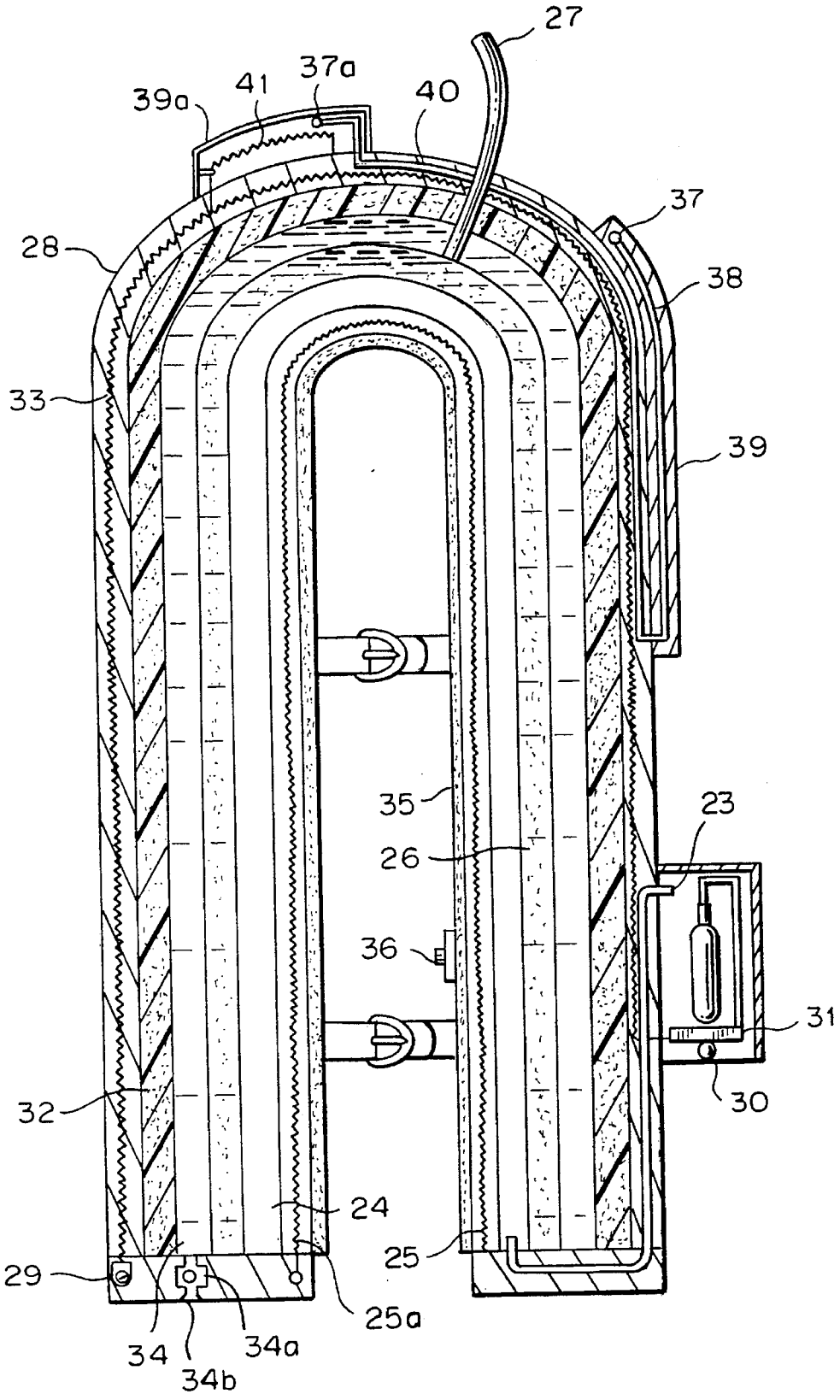
FIG. 3 is a side view of the outdoor survival jacket taken along line 3—3 of FIG. 2, and showing the separate laminae or layers.

As can best be seen in FIG. 2, the lower front portion of the jacket is equipped with an outside case 21 that encloses a gas receptacle 22, and an automatic triggering device that activates or releases compressed air or gas from the gas receptacle into the end of a hose 23 to inflate bladder 24 disposed in an inner portion of the jacket between a heating element layer 25 and a nutriment layer 26 containing water, vitamins and a mixture of minerals. The wearer may orally access the nutrients through an elongated tube 27 which may have an opening or hole for air to go in as nutrient is drawn out. Such air holes and the means for making them are well known in the art. The elongated tube extends from nutrient layer 26 through all layers exterior to it, as can best be seen in FIGS. 1 and 3.

The exterior surface material 28 of the jacket is formed of a waterproof or water impermeable, puncture resistant material, and the exterior surface material completely covers the entire exterior surface of the front portions 11,12, as well as the back portion 15.

Heating coil wires **25*a* are connected to battery supply 29 by electric lead wires (not shown). The inflatable bladder 24 contained within the jacket is in fluid communication with hose 23 so that compressed gas from gas receptacle 22 is releasable to inflate bladder 24**.

Disposed inside of outside case 21 is a water sensing device 30 that signals electric unit 31 to release a spring driven pivotal puncture mechanism to puncture a seal in gas receptacle 22 to commence flow of compressed gas through inlet hose 23 to inflate inflatable bladder 24 to supplement flotation properties provided by solid flotation material layer 32, which is directly beneath outermost layer 33. The puncture mechanism may also be manually operated to release the spring driven puncture device. A supply of shark repellant mixture is disposed within layered section 34, and released on an "as needed" basis by actuating a release mechanism **34*a* to permit the shark repellant to exit the jacket through a hole 34*b*** directly beneath the shark repellant layered section in the bottom part of the back portion of the jacket.

An innermost layered section 35 contains a mixture which is separated within the layer, and which, upon removal of the barrier of separation causes the solutions to mix to create an exothermic reaction that produces heat adjacent to the body area of the wearer upon pressing control button 36.

Pulsating light emitting diode leads 37 are positioned on an end of fiber optic leads 38 to allow light rays therefrom to illuminate fiber optic container 39, which is disposed on the uppermost front portions of the jacket. When the fiber optic container is illuminated with pulsating light, a person wearing the jacket can be seen in cloudy, foggy or dark conditions. The wearer may also be seen under water due to the pulsating lights within the fiber optic container.

Light rays from the light emitting diode pulsating leads travel completely through the fiber optics channel 40 and into pulsating light emitting diode leads **37*a*, disposed on an upper section of the back portion of the jacket, in another fiber optic container 39*a*. The light rays from the light emitting diode pulsating leads that travel completely through the fiber optics to light emitting diode leads 37*a* also travel over photovoltaic solar cells 41, where the rays of light are collected by the solar cells and transformed into electricity that is used by all of the electrically operated units, which include electric heating coil wires 25*a*. Additionally, the light rays from the light emitting diode pulsating leads, after travelling completely through the fiber optics to the upper back portion fiber optic container and over the photovoltaic solar cells where rays of light are collected by the solar cells and transformed into electricity, may be stored in battery supply 29** for future use.

While the optic containers 39 and **39*a*** are preferably disposed on the uppermost front portions of the jacket and an upper section of the back portion of the jacket, the fiber optic containers may conveniently be disposed on any portion of the exterior of the jacket, according to desire.

The exposed surfaces of exterior material 28, as previously mentioned, are constructed of a waterproof, fire resistant material that is difficult to puncture even for sharp objects, such as a shark's teeth, knives, and other like sharp objects.

In the context of the invention, the outdoor survival garment may be designed so as to permit its attachment in the form of a jacket, hood, pants, boots, gloves, etc.:—all of which can be worn as a one-piece or single garment. Each of the attachments may include an electric heating element, and would be adapted to receive electricity through separate counterparts to the source of electricity in the jacket itself or in conjunction with the solar (photovoltaic cells) that supply the jacket.

Figure 4:
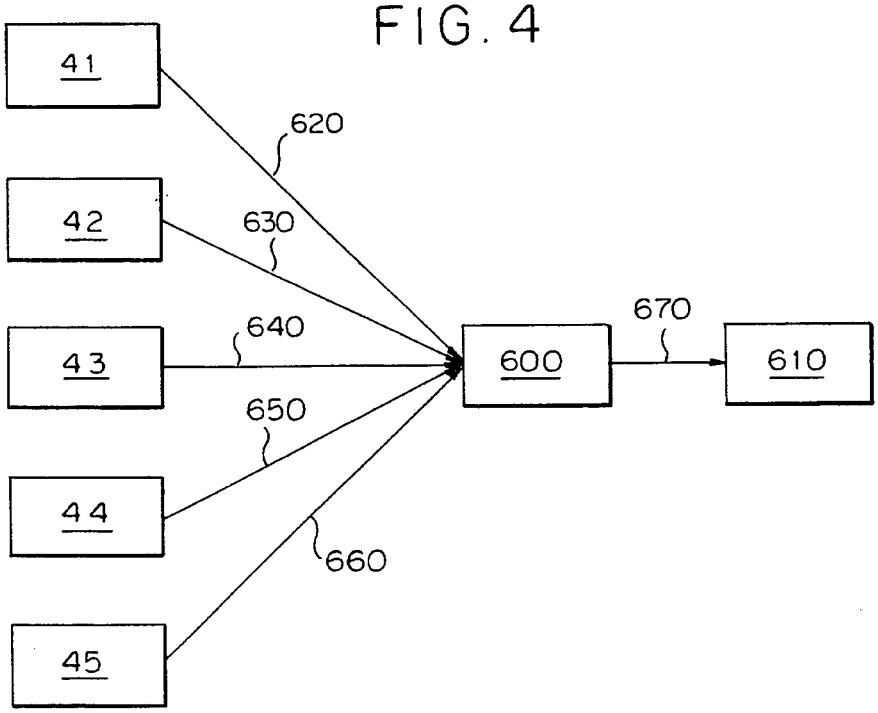
FIG. 4 is a block diagram schematic of the battery charging system.

FIG. 4 presents a sample block diagram schematic of the battery charging system for use with applicants jacket 10. A battery recharging circuit 600, as is typical of circuits of this type, incorporates well known components, all of which, when properly combined, are suitable for the intended purpose of recharging the batteries 610. The batteries 610 are any of the conventional rechargeable type of cells that are well known to those having ordinary skill in the battery art. For instance, applicant has chosen nickel-cadmium cells for rechargeable batteries 610 because of their low cost, favorable ampere-hour rating and lightweight. The recharging circuit 600 is electrically connected to the photovoltaic solar panel 41 via first wires 620 and appropriate electrical terminals. The battery pack 610 is in turn connected to the circuit 600 via second wires 670, thereby allowing the rechargeable batteries 610 to receive the necessary current, which is produced by the recharging circuit 600, required to restore the batteries 610 to their optimum level of electrical operability. Applicant recommends that the jacket 10 be also provided with terminals and fittings which allow the recharging circuit 600 to receive charging power from not only the photovoltaic solar panels 41, but also from a power source on board an R/V vehicle 42, from ordinary current produced by a battery outlet 43, from a power source on board a boat 44, as well as a power source carried by an aircraft 45. The R/V 42, can be operably connected to the circuit 600 via wires 630, while the household current from the outlet 43 is lead to the circuit 600 via wires 640. Similarly, electrical power from the boat 44 is supplied by wires 650, and power from the aircraft 45 is carried by wires 660.

Figure 5:
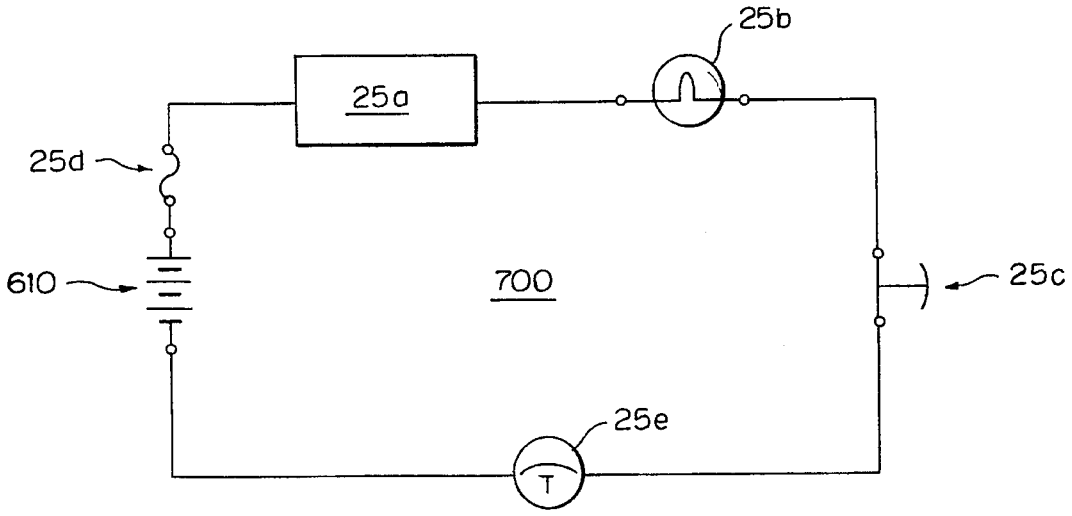
FIG. 5 is a circuit diagram of the heating element layer.

Turning now to FIG. 5, applicant describes the heating element layer 25 in electrical terms. The heating coil wires 25*a* are electrically connected to the rechargeable batteries 610 by current carrying wires in operable electrical circuit 700 in the well known manner. Also, forming part of the electrical circuit 700 is safety fuse 25*d*, an on/off switch 25*c* and a pilot/indicator lamp 25*b*. The heating coil wires 25*a* consist of any reliable resistance wire type heating element. Applicant has chosen a nickel-chromium alloy for its low power demand, its maximum heat output, its relatively low cost, and its reliability of operation. Also forming part of the circuit is a thermostat 25*e* which serves to regulate the temperature of the coil wires 25*a* by interrupting the flow of current through the batteries 610 through the coil wires. A fuse 25*d* is provided to offer safety protection to the wearer of the jacket to prevent accidental and unforeseeable mishap. The setting of the thermostat 25*e* can be adjusted by the wearer manually, in order to offer the maximum amount of comfort. All electrical connections and components are either waterproof or enclosed or otherwise encapsulated against intrusion by both water and/or moisture.

It is to be appreciated that the belt fastener straps 17, the velcro fastener system 19, or the hook and eye fasteners 20 that are used to attach the front and back portions of the jacket or to fasten front portions 11,12 may be replaced by other conventional fastener means such as zippers, spring hooks, buttons, and the like, without departing from the spirit and scope of the invention, and that these other fastener modifications may be utilized without departing from the spirit and scope of the invention, which is defined herewith in the appended claims.

What is claimed is:

1. An outdoor survival garment to protect a wearer from sustained exposure to cold weather on land or at sea, that enables the wearer to communicate distress signals from a lighting system utilizing solar collectors to provide electricity to heating elements and light emitting diode leads disposed at the ends of fiber optical leads, comprising: a garment having front and back portions and an integral connection therebetween; said integral connection includes a pair of shoulder connectors adapted to extend across the shoulders of the wearer to define a neck opening therebetween; at least one separate, releasable connecting strap disposed on and adapted to connect said front and said back portions over each side of the wearer; a first flotation means disposed within said front and back portions to floatingly support a wearer of the jacket in a body of water; a second flotation means disposed within said front and said back portions to supplement said first flotation means, said second flotation means including at least one inflatable bladder disposed within said garment and extending from said front to said back portions; inflation means carried within said garment to selectively inflate said inflatable bladder; an outermost compartment disposed in a front portion of said garment that houses a fiber optic lead immediately in the inside of the outermost compartment, and which houses an LED lighting means underneath a fiber optic lead to collectively provide lighting means; at least one battery in a lowermost section of said back portion of said garment to supply power to said fiber optic and said LED lighting means; an array of photovoltaic solar cells contained within a fiber optic container disposed at a top most section of said back portion of said garment in electrical connection with and serving to repower said fiber optic and said LED lighting means; at least one electrical heating element contained within a layer within a lining next removed from an inner most compartment that extends from said front and said back portions of said garment and includes heating coil wires; and, wherein said battery is in electrical connection with said electrical heater element to supply said electrical heater element with power.

2. An outdoor survival garment of claim 1 in the form of a jacket, wherein said inflation means for inflating said inflatable bladder disposed within said jacket comprises:

an outside casing housing a compressed gas cylinder; said compressed gas cylinder being disposed in communication with an inlet hose leading to said inflatable bladder;

puncture means for puncturing said compressed gas cylinder; and water responsive means for effecting movement of said puncture means to puncture said compressed gas cylinder and cause release of said compressed gas to inflate said inflatable bladder.

3. The outdoor survival jacket of claim 2, wherein said outside casing housing said compressed gas cylinder includes an opening that permits water to enter said casing upon submersion of said jacket in a body of water, and a water sensing element that actuates an electric unit to effect operation of said puncture means.

4. The outdoor survival garment of claim 1, in the form of a jacket wherein said inflation means for selectively inflating at least one inflatable bladder includes a compressed gas container in fluid communication with said at least one inflatable bladder and release means for selectively releasing said gas in said compressed container to cause inflation of said at least one inflatable bladder.

5. The outdoor survival garment of claim 1, in the form of a jacket including at least one layer containing a liquid nutriment; and a tubular connection leading to said layer containing a liquid nutriment to permit mouth access of an individual wearing said jacket.

6. The outdoor survival jacket of claim 5, wherein said nutriment is a liquid nourishment comprising a mixture of water, vitamins and minerals.

7. The outdoor survival garment of claim 1 in the form of a jacket, and including a hood secured thereto, and releasably retained within said back portion of said jacket.

8. The outdoor survival garment of claim 1, wherein said front portion of said garment comprises a pair of separable segments and includes at least one connecting element for releasably connecting said pair of separable segments vertically along said front of said garment; a fixed connection strap extending from said back portion to one member of said pair of separable segments and a second connection strap extending from said back portion to the other member of said pair of said separable segments; said first and said second connection straps being adjustable in length and defining arm holes for an individual wearing said garment; at least one additional connection strap spaced from said first and said second connection straps and extending from said back portion to each one of said pair of separable front segments; said at least one additional connection strap each being adjustable in length to permit adjustment of the fit of said survival garment about the waist of an individual wearing the garment; heating means disposed as a layer within said garment; said heating means including electrical wire coils disposed within said garment; battery power means carried by said garment for supplying electrical power to heat said electrical heating coils; a second heating means also disposed at a layer within said garment; said second heating means being in the form of a pair of separated heat producing liquids that remain inactive until combined to undergo a chemical reaction to produce heat; and means for selectively combining the pair of separated heat producing liquids to form a heat producing layer within said garment.

9. The outdoor survival garment of claim 8 in the form of a jacket, wherein said fiber optic elements are pulsating and disposed in said jacket to enhance visibility of said jacket under a reduced light environment.

10. The outdoor survival jacket of claim 9, including a battery power supply for said pulsating fiber optic elements; said fiber optic elements terminating in LED leads disposed on said jacket; an array of photovoltaic solar cells disposed on a surface of said jacket and adjacent said LED leads; said array of photovoltaic solar cells being in electrical connection with, and serving to recharge and repower said battery supply and said fiber optic elements.

* * * * *